US006986720B2

(12) United States Patent
Sajima et al.

(10) Patent No.: US 6,986,720 B2
(45) Date of Patent: Jan. 17, 2006

(54) GOLF BALL

(75) Inventors: Takahiro Sajima, Kobe (JP); Hideaki Kawamatsu, Kobe (JP); Seiichiro Endo, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 67 days.

(21) Appl. No.: 10/829,341

(22) Filed: Apr. 22, 2004

(65) Prior Publication Data

US 2004/0214663 A1 Oct. 28, 2004

(30) Foreign Application Priority Data

Apr. 25, 2003 (JP) ..... 2003-121250

(51) Int. Cl.
*A63B 37/14* (2006.01)

(52) U.S. Cl. ..... 473/383

(58) Field of Classification Search ..... 473/378–385
See application file for complete search history.

(56) References Cited

U.S. PATENT DOCUMENTS 4,813,677 A 3/1989 Oka et al.
5,735,757 A 4/1998 Moriyama
6,346,053 B1 2/2002 Inoue et al.
2004/0102259 A1 * 5/2004 Ohama et al. ..... 473/378
2004/0142771 A1 * 7/2004 Sajima et al. ..... 473/378

* cited by examiner

*Primary Examiner*—Raeann Gorden
(74) *Attorney, Agent, or Firm*—Birch, Stewart, Kolasch & Birch, LLP

(57) ABSTRACT

Dimple 4 has a side wall curved face 8 and an edge neighboring curved face 9. The side wall curved face 8 is situated between a point P4 positioned downward from the dimple edge Ed by the depth of 20% in an in-depth direction and a point P3 positioned downward from the dimple edge Ed by the depth of 50% in an in-depth direction. The edge neighboring curved face 9 is situated between the dimple edge Ed and a point P5 positioned downward from the dimple edge Ed by the depth of 10% in an in-depth direction. Proportion of the number NL of dimples 4 having the diameter of equal to or greater than 3.90 mm occupied in total number N of the dimples is equal to or greater than 75%. Proportion of the number ML of dimples having the ratio (Re/Rw) between a radius of curvature of Re of the edge neighboring curved face 9 and a radius of curvature Rw of the side wall curved face 8 of 0.5 or greater and 1.5 or less of equal to or greater than 75%, having the diameter of equal to or greater than 3.90 mm and having the radius of curvature Re of 2.0 mm or greater and 5.0 mm or less, occupied in the number NL is equal to or greater than 50%.

3 Claims, 4 Drawing Sheets

GOLF BALL

This application claims priority on patent application No. 2003-121250 filed in Japan on Apr. 25, 2003.

BACKGROUND OF THE INVENTION

1. Field of the Invention

The present invention relates to golf balls. More particularly, the present invention relates to improvement of cross-sectional shape of dimples.

2. Description of the Related Art

Golf balls have numerous dimples on the surface thereof. A role of the dimples involves causing turbulent flow separation through disrupting the air flow around the golf ball during the flight. By causing the turbulent flow separation, a separating point of air from the golf ball shifts backwards leading to the reduction of a drag coefficient (Cd). The turbulent flow separation promotes the differentia, which result from the backspin, between the separating points at the upper and lower sides of the golf ball, thereby enhancing the lift force that acts upon the golf ball. Flight distance of the golf ball is prolonged on behalf of the reduced drag and enhanced lift force. Aerodynamically excellent dimples promote the turbulent flow separation. In other words, aerodynamically excellent dimples can disturb the air flow more efficiently.

A variety of improvements of the cross-sectional shape of the dimples in an attempt to improve the flight performance have been proposed. U.S. Pat. No. 5,735,757 discloses a golf ball provided with double radius dimples having a predetermined shape. U.S. Pat. No. 6,346,053 discloses a golf ball in which an edge angle and a radius of curvature are set to be within a predetermined range.

Density of dimples (may be also referred to as "surface area occupation ratio") is included in specifications that may exert a great influence on flight performances of a golf ball. Golf balls having a great density are excellent in flight performance. A variety of proposals have been made in connection with the density. U.S. Pat. No. 4,813,677 discloses a golf ball provided with dimples that are densely arranged such that any new dimple having an area that is greater than the average area can not be formed.

Diameter of the dimple also exerts a great influence on flight performances of a golf ball. Golf balls that exhibit the drag reduced at the initial stage of a trajectory through the formation of numerous dimples having a great diameter have been placed on the market.

At the impact between a golf ball and a golf club, the surface of the golf ball is scuffed by the face line of the golf club. The nap is thereby raised on the surface of the golf ball. Thus resulting nap markedly deteriorates the appearance of the golf ball. Power is liable to converge in the vicinity of the edge of a dimple, where the nap is readily raised. The nap shall remain along the contour of the dimple.

According to golf balls having a great surface area occupation ratio Y of the dimples, substantial contact area at impact shall be small, therefore, great pressure is applied in the vicinity of the edge. Golf balls having a great surface area occupation ratio Y are liable to fuzz up the nap. Because the nap remains along the contour of the dimple as described above, fuzzing up of the nap is remarkable for dimples having a long contour length, in other words, for dimples having a great diameter. There is an urgent need to suppress deterioration of the appearance of golf balls having dimples with a great diameter and having a great surface area occupation ratio Y.

An object of the present invention is to provide a golf ball that is excellent in a flight performance and is resistant to fuzzing up of the nap.

SUMMARY OF THE INVENTION

The golf ball according to the present invention has numerous dimples on the surface thereof. Surface area occupation ratio Y of these dimples is equal to or greater than 75%. Proportion of the number NL of dimples having the diameter of equal to or greater than 3.90 mm occupied in total number N of the dimples is equal to or greater than 75%. Proportion of the number ML of dimples having the diameter of equal to or greater than 3.90 mm, complying with the following formula (1) and having a radius of curvature Re in the following formula (1) of 2.0 mm or greater and 5.0 mm or less, occupied in the number NL is equal to or greater than 50%:

$$0.5 \leqq Re/Rw \leqq 1.5 \quad (1)$$

wherein Re represents a radius of curvature of a curved surface between the dimple edge and a point positioned downward from the dimple edge by the depth of 10% in an in-depth direction; wherein Rw represents a radius of curvature of a curved surface between a point positioned downward from the dimple edge by the depth of 20% in an in-depth direction and a point positioned downward from the dimple edge by the depth of 50% in an in-depth direction. Ratio (Re/Rw) in this golf ball is greater in comparison with the ratio (Re/Rw) in conventional golf balls. Dimples having the ratio (Re/Rw) of 0.5 or greater and 1.5 or less are responsible for the flight performance. This dimple is resistant to fuzzing up of the nap.

Proportion of the number ML occupied in the number NL is ideally 100%. In light of the flight performance and suppression of fuzzing up of the nap, the proportion of the number M of the dimples that comply with the formula (1) occupied in total number N is preferably equal to or greater than 90%.

DESCRIPTION OF THE PREFERRED EMBODIMENTS

The present invention is hereinafter described in detail with appropriate references to the accompanying drawing according to the preferred embodiments of the present invention.

Figure 1:
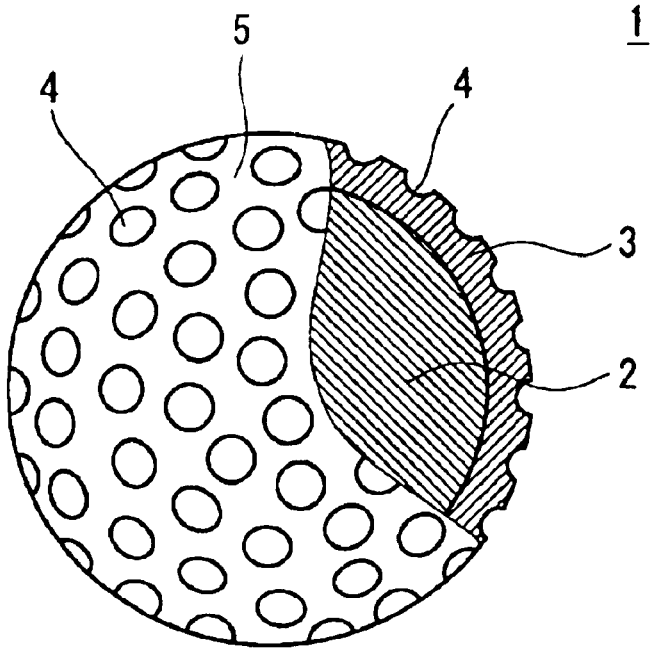
FIG. 1 is a cross-sectional view with a partially cut off part illustrating a golf ball according to one embodiment of the present invention.

A golf ball 1 depicted in FIG. 1 has a spherical core 2 and a cover 3. Numerous dimples 4 are formed on the surface of the cover 3. Of the surface of the golf ball 1, parts other than the dimples 4 are lands 5. This golf ball 1 has a paint layer and a mark layer to the external side of the cover 3, although these layers are not shown in the Figure.

This golf ball 1 has a diameter of from 40 mm to 45 mm in general, and in particular, of from 42 mm to 44 mm. In light of the reduction of the air resistance in the range to comply with a rule defined by United States Golf Association (USGA), the diameter is particularly preferably 42.67 mm or greater and 42.85 mm or less. Weight of this golf ball 1 is generally 40 g or greater and 50 g or less, and particularly 44 g or greater and 47 g or less. In light of elevation of inertia in the range to comply with a rule defined by USGA, the weight is particularly preferably 45.00 g or greater and 45.93 g or less.

The core 2 is formed through crosslinking of a rubber composition. Illustrative examples of a base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high cis-polybutadienes are preferred.

For crosslinking of the core 2, a co-crosslinking agent is usually used. Preferable examples of the co-crosslinking agent in light of the resilience performance include zinc acrylate, magnesium acrylate, zinc methacrylate and magnesium methacrylate. In the rubber composition, an organic peroxide may be preferably blended together with the co-crosslinking agent. Examples of suitable organic peroxide include dicumyl peroxide, 1, 1-bis(t-butylperoxy)-3, 3, 5-trimethylcyclohexane, 2, 5-dimethyl-2, 5-di(t-butylperoxy)hexane and di-t-butyl peroxide.

Various kinds of additives such as a filler, sulfur, an anti-aging agent, a coloring agent, a plasticizer, a dispersant and the like may be blended at an appropriate amount to the rubber composition as needed. Crosslinked rubber powder or synthetic resin powder may be further blended to the core 2.

The core 2 has the diameter of usually 30.0 mm or greater and 42.0 mm or less, and particularly of 38.0 mm or greater and 41.5 mm or less. The core 2 may be composed of two or more layers.

The cover 3 is formed from a synthetic resin composition. Illustrative examples of the base resin for use in the cover 3 include ionomer resins, thermoplastic styrene elastomers, thermoplastic polyurethane elastomers, thermoplastic polyamide elastomers, thermoplastic polyester elastomers and thermoplastic polyolefin elastomers.

An appropriate amount of a coloring agent, a filler, a dispersant, an antioxidant, an ultraviolet absorbent, a light stabilizer, a fluorescent agent, a fluorescent brightening agent or the like may be blended to the cover 3 as needed. For the purpose of adjusting the specific gravity, powder of a highly dense metal such as tungsten, molybdenum or the like may be blended to the cover 3.

The cover 3 has the thickness of usually 0.3 mm or greater and 6.0 mm or less, and particularly of 0.6 mm or greater and 2.4 mm or less. The cover 3 may be composed of two or more layers.

Figure 2:
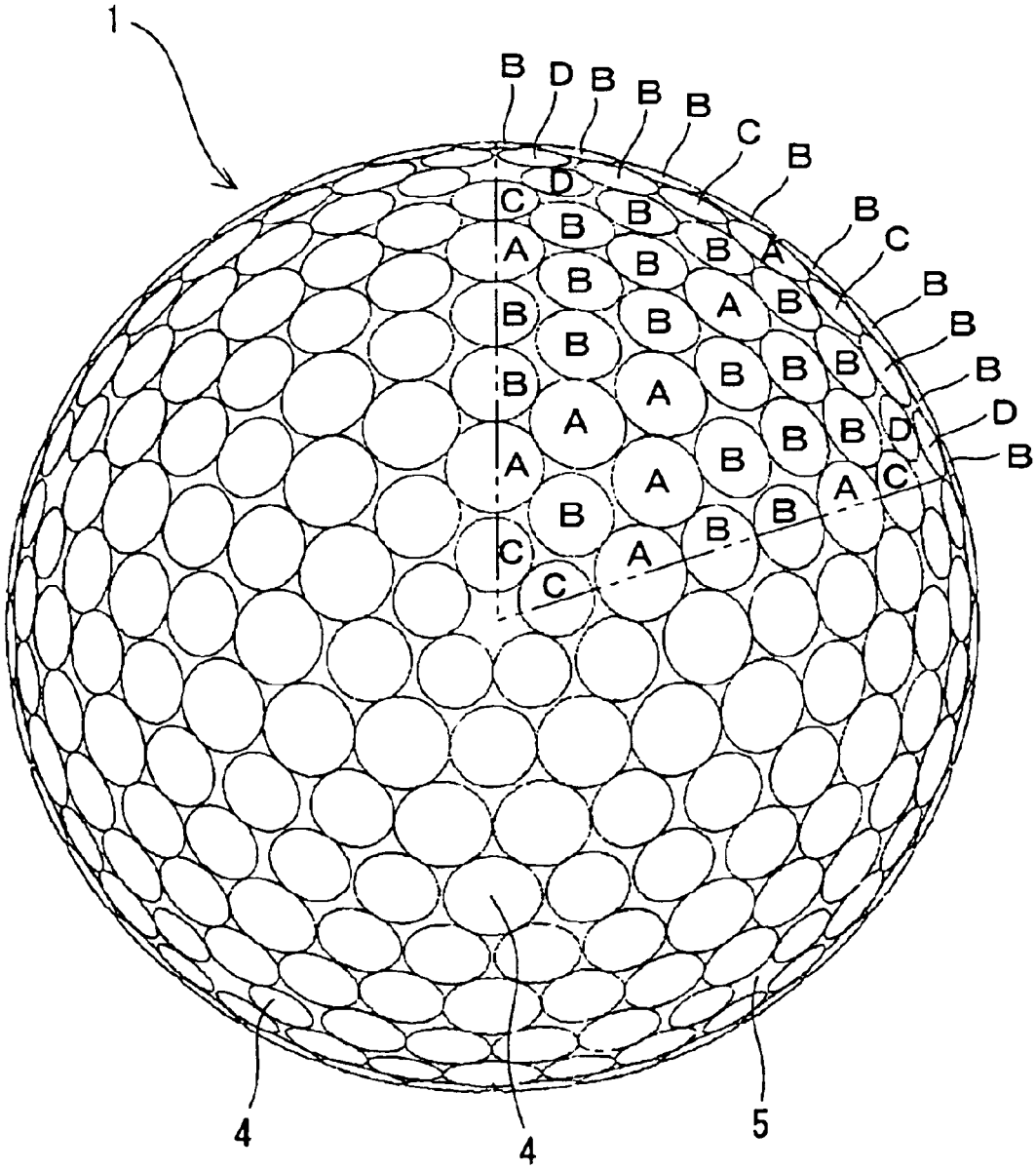
FIG. 2 is an enlarged plan view illustrating the golf ball shown in FIG. 1.

FIG. 2 is an enlarged plan view illustrating the golf ball 1 shown in FIG. 1. As is clear from FIG. 2, the plane shape of all the dimples 4 is circular. In FIG. 2, four types of the dimples 4 are illustrated by reference symbols A to D with respect to one unit given by comparting the surface of the golf ball 1 into 10 equivalent units. This golf ball 1 has dimples A with the diameter of 4.35 mm, dimples B with the diameter of 3.90 mm, dimples C with the diameter of 3.40 mm, and dimples D with the diameter of 3.20 mm. The number of the dimples A is 70; the number of the dimples B is 260; the number of the dimples C is 40; and the number of the dimples D is 40. Total number of the dimples 4 of this golf ball 1 is 410.

Proportion of total area of dimples 4 occupied in the surface area of a phantom sphere is referred to as surface area occupation ratio Y. The surface area occupation ratio Y of the golf ball 1 according to the present invention is equal to or greater than 75%. When the surface area occupation ratio Y is less than the above range, the flight performance of the golf ball 1 may become insufficient. In this respect, the surface area occupation ratio Y is more preferably equal to or greater than 76%, and particularly preferably equal to or greater than 77%. When the surface area occupation ratio Y is too great, a dimple 4 may interfere with other dimple 4. In this respect, the surface area occupation ratio Y is preferably equal to or less than 90%, more preferably equal to or less than 88%, and particularly preferably equal to or less than 87%.

Surface area of the dimple 4 is the area of a region surrounded by an edge line when the center of the golf ball 1 is viewed at infinity (i.e., area of the plane shape). The area s is calculated by the following formula in case of a dimple 4 having a plane shape of circular:

$$s=(d/2)^2\cdot\pi.$$

In the golf ball 1 depicted in FIG. 2, the area of the dimple A is 14.862 $mm^2$; the area of the dimple B is 11.946 $mm^2$; the area of the dimple C is 9.079 $mm^2$; and the area of the dimple D is 8.042 $mm^2$. Total area of these dimples is 4831.1 $mm^2$. The surface area occupation ratio is calculated by dividing this total area by the surface area of the phantom sphere. According to this golf ball 1, the surface area occupation ratio is 84%.

Figure 3:
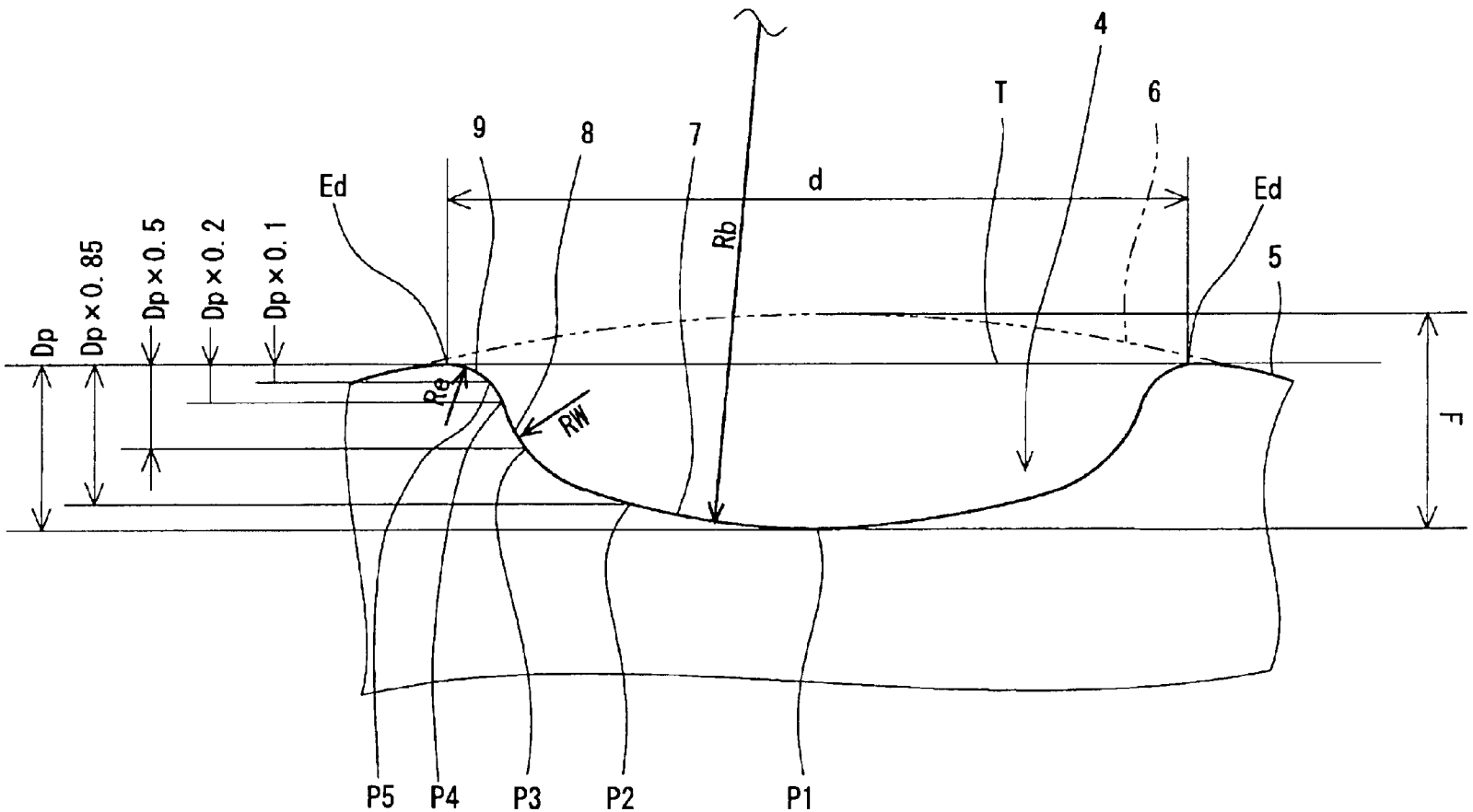
FIG. 3 is an enlarged cross-sectional view illustrating a part of the golf ball 1 shown in FIG. 1.

FIG. 3 is an enlarged cross-sectional view illustrating a part of the golf ball 1 shown in FIG. 1. In this Figure, a cross-section is illustrated which passes through the deepest site of the dimple 4 and the center of the golf ball 1. Vertical direction in FIG. 3 is an in-depth direction of the dimple 4. The in-depth direction is a direction heading from the center of gravity on the surface of the dimple 4 toward the center of the golf ball 1. What is indicated by a chain double-dashed line in FIG. 3 is a phantom sphere 6. The surface of the phantom sphere 6 is the surface of the golf ball 1 to be present when it is postulated that no dimple 4 exists. The dimple 4 is recessed from the phantom sphere 6. The lands 5 agree with the phantom sphere 6.

What is indicated by a both-sided arrowhead d in FIG. 3 is the diameter of the dimple 4. This diameter d is the distance between one contact point Ed and another contact point Ed when a tangent line T that is common to both sides of the dimple 4 is depicted. The contact points Ed also constitute the edge of the dimple 4. The edges Ed define the plane shape of the dimple 4. What is indicated by a symbol P1 in FIG. 3 is the deepest part of the dimple 4. The distance between the tangent line T and the deepest part P1 is the depth Dp of the dimple 4.

What is indicated by the symbol P2 in FIG. 3 is a point positioned downward from the edge Ed by the distance of (Dp·0.85). What is indicated by the symbol P3 is a point positioned downward from the edge Ed by the distance of (Dp·0.5). What is indicated by the symbol P4 is a point positioned downward from the edge Ed by the distance of (Dp·0.2). What is indicated by the symbol P5 is a point positioned downward from the edge Ed by the distance of (Dp·0.1).

The dimple 4 comprises a bottom curved face 7, a side wall curved face 8 and an edge neighboring curved face 9.

The bottom curved face 7 is bowl-shaped, and the side wall curved face 8 and the edge neighboring curved face 9 are ring-shaped. The bottom curved face 7 is situated lower than the point P2. The bottom curved face 7 includes the deepest part P1. The side wall curved face 8 is situated between the point P3 and the point P4. The edge neighboring curved face 9 is situated upper than the point p5.

The bottom curved face 7 is inwardly convex in its entirety. The bottom curved face 7 may be outwardly convex in part, or may also be flat in part with respect to both inward and outward directions. It is preferred that the curved face is inwardly convex for all the points on the bottom curved face 7. The side wall curved face 8 is inwardly convex in its entirety. The side wall curved face 8 may be outwardly convex in part, or may also be flat in part with respect to both inward and outward directions. It is preferred that the curved face is inwardly convex for all the points on the side wall curved face 8. The edge neighboring curved face 9 is outwardly convex in its entirety. The edge neighboring curved face 9 may be inwardly convex in part, or may also be flat in part with respect to both inward and outward directions. It is preferred that the curved face is outwardly convex for all the points on the edge neighboring curved face 9.

Radius of curvature Rb of the bottom curved face 7 is a radius of a circular arc that is envisioned to pass through three points, i.e., the point P2 shown in FIG. 3; other point P2 positioned opposite to this point P2 with the deepest part P1 interposed therebetween; and the deepest part P1. The radius of curvature Rw of the side wall curved face 8 is a radius of a circular arc that is envisioned to pass through three points, i.e., the point P3; a point positioned downward from the edge Ed by the distance of (Dp·0.35); and the point P4. The radius of curvature Re of the edge neighboring curved face 9 is a radius of a circular arc that is envisioned to pass through three points, i.e., the point P5; a point positioned downward from the edge Ed by the distance of (Dp·0.05); and the edge Ed.

The dimple 4 shown in FIG. 3 complies with the above-described formula (1). In other words, the ratio (Re/Rw) is equal to or greater than 0.5 in this dimple 4. According to general golf balls in prior arts, the ratio (Re/Rw) is equal to or less than 0.2. The ratio (Re/Rw) according to the golf ball 1 shown in FIG. 3 is great. In other words, the radius of curvature Re is comparatively great, whilst the radius of curvature Rw is comparatively small in this dimple 4. On behalf of the great radius of curvature Re, convergence of power at impact onto the edge neighboring curved face 9 hardly occurs. According to the golf ball 1 having this type of dimple 4, fuzzing up of the nap is suppressed in spite of formation of a large number of dimples 4 having a great surface area occupation ratio Y and having a great diameter. Because the radius of curvature Rw of the side wall curved face 9 is small, the angle of gradient with respect to the phantom sphere 6 is great for this side wall curved face 8. This side wall curved face 8 exerts an excellent effect in disturbing the flow of air. Although the edge neighboring curved face 9 having a great radius of curvature Re exerts an inferior effect in disturbing the flow of air, the side wall curved face 8 compensates for the edge neighboring curved face 9 in connection with the flight performance. According to the golf ball 1 having this type of dimple 4, deterioration of the appearance hardly occurs, and the flight performance is maintained. In light of the achievement in both terms of the appearance and the flight performance, the ratio (Re/Rw) is more preferably equal to or greater than 0.6, and particularly preferably equal to or greater than 0.7.

Because too great ratio (Re/Rw) results in a hopping trajectory, the ratio (Re/Rw) is set to be equal to or less than 1.5. It is preferred that the ratio (Re/Rw) is equal to or less than 1.3, still more equal to or less than 1.2, and yet more equal to or less than 1.1.

In light of the suppression of fuzzing up of the nap, the radius of curvature Re of the edge neighboring curved face 9 is set to be equal to or greater than 2.0 mm. The radius of curvature Re is more preferably equal to or greater than 2.2 mm, and particularly preferably equal to or greater than 2.4 mm. In light of the flight performance, the radius of curvature Re is set to be equal to or less than 5.0 mm. The radius of curvature Re is more preferably equal to or less than 4.8 mm, and particularly preferably equal to or less than 4.6 mm.

In light of the suppression of fuzzing up of the nap, the radius of curvature Rw of the side wall curved face 8 is preferably equal to or greater than 1.0 mm, more preferably equal to or greater than 2.0 mm, and particularly preferably equal to or greater than 3.0 mm. In light of the flight performance, the radius of curvature Rw is preferably equal to or less than 10.0 mm, more preferably equal to or less than 9.0 mm, and particularly preferably equal to or less than 8.0 mm.

The number of the dimples 4 is herein shown by any of the following symbols:

N: total number of the dimples 4;

NL: number of the dimples 4 having the diameter of equal to or greater than 3.90 mm;

M: number of the dimples 4 that comply with the above-described formula (1); and ML: number of the dimples having the diameter of equal to or greater than 3.90 mm, complying with the above-described formula (1) and having a radius of curvature Re of 2.0 mm or greater and 5.0 mm or less.

According to the present invention, a proportion of the number NL occupied in the total number N is equal to or greater than 75%. In other words, the golf ball 1 according to the present invention has a large number of great dimples 4. This golf ball 1 is excellent in the flight performance. One of the grounds for the excellent flight performance of this golf ball 1 is estimated that the dimples 4 having the diameter of equal to or greater than 3.90 mm are responsible for reduction of the drag at the initial stage of a trajectory. In light of the flight performance, the proportion of the number NL occupied in the total number N is more preferably equal to or greater than 77%, and particularly preferably equal to or greater than 80%. Upper limit of this proportion is 100%.

According to the present invention, the proportion of the number ML occupied in the number NL is equal to or greater than 50%. In other words, for the great dimples 4, the ratio (Re/Rw) is set to be within the range of 0.5 or greater and 1.5 or less as far as possible, and the radius of curvature Re is set to be 2.0 mm or greater and 5.0 mm or less as far as possible. Deterioration of the appearance of the golf ball 1 is thereby suppressed. It is preferred that the proportion of the number NL occupied in the number ML is equal to or greater than 70%, still more equal to or greater than 85%, and even more equal to or greater than 90%. This proportion is ideally 100%.

According to the present invention, the proportion of the number M occupied in the total number N is preferably equal to or greater than 90%. In other words, the ratio (Re/Rw) is set to be within the range of 0.5 or greater and 1.5 or less as far as possible for individual dimples 4 irrespective of the diameter. Deterioration of the appearance of the golf ball 1 is thereby suppressed. The proportion of the number M occupied in the total number N is more preferably equal to or greater than 95%. This proportion is ideally 100%.

The radius of curvature Rb of the bottom curved face 7 is determined ad libitum to fall within the range such that the optimum dimple volume is obtained. The radius of curvature Rb is set to be usually of from 2 mm to 60 mm, still more of from 4 mm to 59 mm, even more of from 5 mm to 58 mm, yet more of from 10 mm to 57 mm, further still more of from 15 mm to 56 mm, and yet still more of from 20 mm to 55 mm.

What is indicated by a both-sided arrowhead F in FIG. 3 is the distance between the phantom sphere 6 and the deepest part P1. It is preferred that the distance F is 0.10 mm or greater and 0.60 mm or less. When the distance F is less than the above range, a hopping trajectory may be provided. In this respect, the distance F is more preferably equal to or greater than 0.125 mm, and particularly preferably equal to or greater than 0.14 mm. When the distance F is beyond than the above range, a dropping trajectory may be provided. In this respect, the distance F is more preferably equal to or less than 0.55 mm, and particularly preferably equal to or less than 0.50 mm.

In FIG. 3, the volume surrounded by the phantom sphere 4 and the dimple 4 is the volume of the dimple 4. It is preferred that total volume of the dimples 4 is 300 $m^3$ or greater and 700 $mm^3$ or less. When the total volume is less than the above range, a hopping trajectory may be provided. In this respect, the total volume V is more preferably equal to or greater than 350 $mm^3$, and particularly preferably equal to or greater than 400 $mm^3$. When the total volume V is beyond the above range, a dropping trajectory may be provided. In this respect, the total volume is more preferably equal to or less than 650 $mm^3$, and particularly preferably equal to or less than 600 $mm^3$.

In the golf ball 1 shown in FIG. 1 to FIG. 3, the volume of the dimple A is 1.793 $mm^3$; the volume of the dimple B is 1.311 $mm^3$; the volume of the dimple C is 0.899 $mm^3$; and the volume of the dimple D is 0.754 $mm^3$. Total volume of this golf ball 1 is 532.4 $mm^3$.

It is preferred that total number of the dimples 4 is 200 or greater and 500 or less. When the total number is less than the above range, the dimple effect is hardly achieved. In this respect, the total number is more preferably equal to or greater than 230, and particularly preferably equal to or greater than 260. When the total number is beyond the above range, achieving the dimple effect may be difficult due to small size of the individual dimples 4. In this respect, the total number is more preferably equal to or less than 470, and particularly preferably equal to or less than 440.

The dimples 4 to be formed may be of a single type, or may be of multiple types. In stead of the circular dimples 4, or together with the circular dimples 4, non-circular dimples (dimples having the plane shape which is not circular) may be also formed. Specific examples of the non-circular dimple include polygonal dimples, elliptical dimples, oval dimples and egg-shaped dimples. In cases of the non-circular dimple, four cross sections are selected through dividing the dimple every 45°, then the radius of curvature Rb, Rw and Re as well as the distance F are measured for these cross sections. Thus resulting data are averaged.

Dimple specifications such as the radius of curvature, diameter d, depth Dp, distance F, volume and the like are determined by actual measurement of the golf ball 1. The radius of curvature Re of the edge neighboring curved face 9 is measured at a site that is adjacent to the land 5 having a sufficient size.

Although the golf ball 1 illustrated in FIG. 1 has a two-piece structure, flight performance can be also improved in multi-piece golf balls, wound golf balls or one-piece golf balls by setting appropriate cross sectional shape of dimple.

EXAMPLES

Example 1

A core comprising a solid rubber and having the diameter of 38.4 mm was placed into a mold, and a cover layer was formed through injecting an ionomer resin composition around the core. Paint was applied over the surface of this cover layer to obtain a golf ball of Example 1 having a dimple pattern shown in FIG. 2. Specifications of dimples of this golf ball are listed in Table 1 below. This golf ball has the external diameter of about 42.70 mm, and the weight of about 45.4 g. Compression of the golf ball as measured with a compression tester available from Atti Engineering Co., Ltd. was about 85.

Examples 2 to 5 and Comparative Examples 1 to 5

In a similar manner to Example 1 except that specifications of the dimples were set to be as presented in Table 1 and Table 2 below, golf balls of Examples 2 to 5 and Comparative Examples 1 to 5 were obtained. Dimple pattern of the golf ball of Example 2 is illustrated in FIG. 4.

TABLE 1

Figure 4:
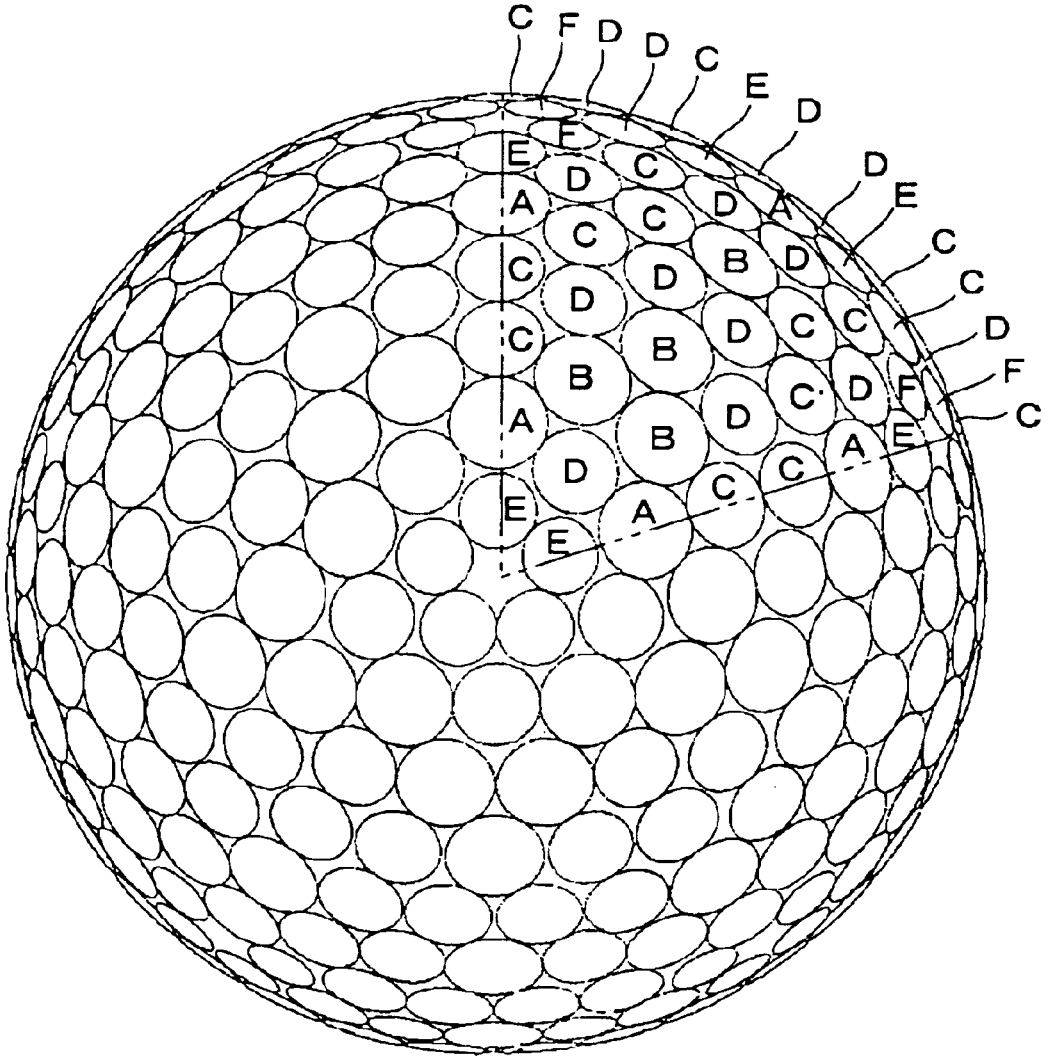
FIG. 4 is a plan view illustrating a golf ball according to Example 2 of the present invention.

| | | Specification of dimple | | | | | | | |
|---|---|---|---|---|---|---|---|---|---|
| | | Number | d (mm) | F (mm) | Re (mm) | Rw (mm) | Re/Rw | Volume ($mm^3$) | Figure |
| Example 1 | A | 70 | 4.35 | 0.2196 | 3.0 | 4.0 | 0.75 | 1.793 | FIG. 2 |
| | B | 260 | 3.90 | 0.2052 | 3.0 | 4.0 | 0.75 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| Example 2 | A | 50 | 4.35 | 0.2181 | 3.0 | 3.0 | 1.00 | 1.793 | FIG. 4 |
| | B | 20 | 4.35 | 0.2411 | 0.5 | 18.3 | 0.03 | 1.793 | |
| | C | 150 | 3.90 | 0.2032 | 3.0 | 3.0 | 1.00 | 1.311 | |
| | D | 110 | 3.90 | 0.2192 | 0.5 | 14.7 | 0.03 | 1.311 | |
| | E | 40 | 3.40 | 0.1978 | 0.5 | 11.2 | 0.04 | 0.899 | |
| | F | 40 | 3.20 | 0.1870 | 0.5 | 10.1 | 0.05 | 0.754 | |
| Example 3 | A | 70 | 4.35 | 0.2181 | 3.0 | 3.0 | 1.00 | 1.793 | FIG. 2 |
| | B | 260 | 3.90 | 0.2032 | 3.0 | 3.0 | 1.00 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |

TABLE 1-continued

| | | Specification of dimple | | | | | | | |
|---|---|---|---|---|---|---|---|---|---|
| | | Number | d (mm) | F (mm) | Re (mm) | Rw (mm) | Re/Rw | Volume ($mm^3$) | Figure |
| Example 4 | A | 70 | 4.35 | 0.2181 | 3.0 | 3.0 | 1.00 | 1.793 | FIG. 2 |
| | B | 260 | 3.90 | 0.2032 | 3.0 | 3.0 | 1.00 | 1.311 | |
| | C | 40 | 3.40 | 0.1721 | 3.0 | 3.0 | 1.00 | 0.899 | |
| | D | 40 | 3.20 | 0.1590 | 3.0 | 3.0 | 1.00 | 0.754 | |
| Example 5 | A | 70 | 4.35 | 0.2243 | 3.0 | 6.0 | 0.50 | 1.793 | FIG. 2 |
| | B | 260 | 3.90 | 0.2097 | 3.0 | 6.0 | 0.50 | 1.311 | |
| | C | 40 | 3.40 | 0.1978 | 0.5 | 11.2 | 0.04 | 0899 | |
| | D | 40 | 3.20 | 0.1870 | 0.5 | 10.1 | 0.05 | 0754 | |

TABLE 2

| | | Specification of dimple | | | | | | | |
|---|---|---|---|---|---|---|---|---|---|
| | | Number | d (mm) | F (mm) | Re (mm) | Rw (mm) | Re/Rw | Volume ($mm^3$) | Figure |
| Comparative Example 1 | A | 70 | 4.35 | 0.2411 | 0.5 | 18.3 | 0.03 | 1.793 | FIG. 2 |
| | B | 260 | 3.90 | 0.2192 | 0.5 | 14.7 | 0.03 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| Comparative Example 2 | A | 70 | 4.35 | 0.2164 | 1.0 | 1.0 | 1.00 | 1.793 | FIG. 2 |
| | B | 260 | 3.90 | 0.1985 | 1.0 | 1.0 | 1.00 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| Comparative Example 3 | A | 70 | 4.35 | 0.2286 | 3.0 | 9.0 | 0.33 | 1.793 | FIG. 2 |
| | B | 260 | 3.90 | 0.2179 | 3.0 | 9.0 | 0.33 | 1.311 | |
| | C | 40 | 3.40 | 0.1978 | 0.5 | 11.2 | 0.04 | 0899 | |
| | D | 40 | 3.20 | 0.1870 | 0.5 | 10.1 | 0.05 | 0.754 | |
| Comparative Example 4 | A | 70 | 4.35 | 0.2261 | 6.0 | 6.0 | 1.00 | 1.793 | FIG. 2 |
| | B | 260 | 3.90 | 0.2127 | 6.0 | 6.0 | 1.00 | 1.311 | |
| | C | 40 | 3.40 | 0.1978 | 0.5 | 11.2 | 0.04 | 0.899 | |
| | D | 40 | 3.20 | 0.1870 | 0.5 | 10.1 | 0.05 | 0.754 | |
| Comparative Example 5 | A | 70 | 4.35 | 0.2181 | 2.0 | 1.0 | 2.00 | 1.793 | FIG. 2 |
| | B | 260 | 3.90 | 0.2032 | 2.0 | 1.0 | 2.00 | 1.311 | |
| | C | 40 | 3.40 | 0.1721 | 0.5 | 13.9 | 0.04 | 0.899 | |
| | D | 40 | 3.20 | 0.1590 | 0.5 | 13.0 | 0.04 | 0.754 | |

[Travel Distance Test]

A driver with a metal head ("XXIO W#1", available from Sumitomo Rubber Industries, Ltd., loft: 8°, shaft hardness: X) was equipped with a swing machine (manufactured by True Temper Co.). Then the golf ball was hit under a condition to give the head speed of 49 m/sec, the launch angle of about 11°, and the back spin rate of about 3000 rpm. Accordingly, travel distance (i.e., the distance from the launching point to the point where the ball stopped) was measured. During the measurement, almost no wind was observed. Mean values of 20 times measurement are shown in Table 3 below.

[Evaluation of Appearance]

Appearance of the golf ball subjected to the travel distance test as described above was visually observed, and the extent of fuzzing up of the nap was classified into five ranks of from "A" to "E". Those with minimum fuzzing up of the nap were classified into the rank "A", and those with maximum fuzzing up of the nap were classified into the rank "E". These results are shown in Table 3 below.

TABLE 3

| | Result of evaluation | | | | | | | | | |
|---|---|---|---|---|---|---|---|---|---|---|
| | Example 1 | Example 2 | Example 3 | Example 4 | Example 5 | Comp. Example 1 | Comp. Example 2 | Comp. Example 3 | Comp. Example 4 | Comp. Example 5 |
| Total number N | 410 | 410 | 410 | 410 | 410 | 410 | 410 | 410 | 410 | 410 |
| Number NL *1 | 330 | 330 | 330 | 330 | 330 | 330 | 330 | 330 | 330 | 330 |
| Number M *2 | 330 | 200 | 330 | 410 | 330 | 0 | 330 | 0 | 330 | 0 |
| Number ML *3 | 330 | 200 | 330 | 330 | 330 | 0 | 0 | 0 | 0 | 0 |
| NL/N (%) | 80.5 | 80.5 | 80.5 | 80.5 | 80.5 | 80.5 | 80.5 | 80.5 | 80.5 | 80.5 |
| ML/NL (%) | 100.0 | 60.6 | 100.0 | 100.0 | 100.0 | 0.0 | 100.0 | 0.0 | 100.0 | 0.0 |
| M/N (%) | 80.5 | 48.8 | 80.5 | 100.0 | 80.5 | 0.0 | 80.5 | 0.0 | 80.5 | 0.0 |
| Surface area occupation ratio Y (%) | 84 | 84 | 84 | 84 | 84 | 84 | 84 | 84 | 84 | 84 |
| Total volume ($mm^3$) | 532.4 | 532.4 | 532.4 | 532.4 | 532.4 | 532.4 | 532.4 | 532.4 | 532.4 | 532.4 |

TABLE 3-continued

| | Result of evaluation | | | | | | | | | |
|---|---|---|---|---|---|---|---|---|---|---|
| | Example 1 | Example 2 | Example 3 | Example 4 | Example 5 | Comp. Example 1 | Comp. Example 2 | Comp. Example 3 | Comp. Example 4 | Comp. Example 5 |
| Travel distance (m) | 238.0 | 237.3 | 239.2 | 239.5 | 236.1 | 233.7 | 236.8 | 233.4 | 232.0 | 236.4 |
| Appearance | A | C | B | A | A | D | E | A | A | C |

*1 Number of dimples having the diameter of equal to or greater than 3.90 mm
*2 Number of dimples that comply with the formula (1)
*3 Number of dimples having the diameter of equal to or greater than 3.90 mm, complying with the formula (1) and having a radius of curvature of 2.0 mm or greater and 5.0 mm or less As is clear from Table 3, the golf ball of each of Examples achieves greater travel distance than the golf ball of Comparative Examples. In addition, the appearance of the golf ball of each of Examples was ranked as C or higher. Therefore, advantages of the present invention are clearly indicated by these results of evaluation.

The description herein above is just for an illustrative example, therefore, various modifications can be made without departing from the principles of the present invention.

What is claimed is:

1. A golf ball having numerous dimples on the surface thereof, wherein surface area occupation ratio Y of said dimples is equal to or greater than 75%, proportion of the number NL of dimples having the diameter of equal to or greater than 3.90 mm occupied in total number N of the dimples is equal to or greater than 75%, and proportion of the number ML of dimples, having the diameter of equal to or greater than 3.90 mm, complying with the following formula (1) and having a radius of curvature Re in the following formula (1) of 2.0 mm or greater and 5.0 mm or less, occupied in the number NL is equal to or greater than 50%:

$$0.5 \leqq Re/Rw \leqq 1.5 \quad (1)$$

wherein: Re represents a radius of curvature of a curved surface between the dimple edge and a point positioned downward from the dimple edge by the depth of 10% in an in-depth direction; Rw represents a radius of curvature of a curved surface between a point positioned downward from the dimple edge by the depth of 20% in an in-depth direction and a point positioned downward from the dimple edge by the depth of 50% in an in-depth direction.

2. The golf ball according to claim 1 wherein the proportion of said number ML occupied in said number NL is 100%.

3. The golf ball according to claim 1 wherein the proportion of the number M of the dimples that comply with the above-described formula (1) occupied in total number N is equal to or greater than 90%.

* * * * *